US007059591B2

(12) United States Patent
Bortkevitch et al.

(10) Patent No.: US 7,059,591 B2
(45) Date of Patent: Jun. 13, 2006

(54) METHOD AND APPARATUS FOR ENHANCED OIL RECOVERY BY INJECTION OF A MICRO-DISPERSED GAS-LIQUID MIXTURE INTO THE OIL-BEARING FORMATION

(76) Inventors: Sergey V. Bortkevitch, Leninsky, 73/8, No. 38, Moscow (RU); Sergey A. Kostrov, 6021 Arbor Hills Way No. 15, The Colony, TX (US) 75056; Nickolay V. Savitsky, Koutouzovsky, 43, No. 180, Moscow (RU); William O. Wooden, 5928 Henley Dr., Plano, TX (US) 75093

( * ) Notice: Subject to any disclaimer, the term of this patent is extended or adjusted under 35 U.S.C. 154(b) by 0 days.

(21) Appl. No.: 10/682,286

(22) Filed: Oct. 10, 2003

(65) Prior Publication Data

US 2005/0077636 A1 Apr. 14, 2005

(51) Int. Cl.
*B01F 3/04* (2006.01)

(52) U.S. Cl. ..... 261/76; 261/79.2; 261/DIG. 75

(58) Field of Classification Search ..... 261/76, 261/79.2, 116, DIG. 39, DIG. 75
See application file for complete search history.

(56) References Cited

U.S. PATENT DOCUMENTS 3,774,846 A * 11/1973 Schurig et al. ..... 239/427.3
4,152,409 A * 5/1979 Nagao et al. ..... 423/659
4,808,346 A * 2/1989 Strenger ..... 261/18.1
4,861,165 A * 8/1989 Fredriksson et al. ..... 366/165.1
4,885,084 A * 12/1989 Doyle ..... 210/132
6,082,712 A * 7/2000 Cincotta et al. ..... 261/76
6,546,962 B1 * 4/2003 Sunde ..... 137/893
2004/0251566 A1 * 12/2004 Kozyuk ..... 261/76

* cited by examiner

*Primary Examiner*—Scott Bushey

(57) ABSTRACT

The method and apparatus for making a micro-dispersed gas-liquid mixture which includes a gas-liquid ejector unit, a cavitation unit and a jet dispersing unit installed in a sequence. All above referenced units are installed into a cylindrical housing which in turn includes bottom and top covers and also has a first partition having a conical orifice separating a gas-liquid ejector unit from a cavitation unit and a second partition separating a cavitation unit from a jet dispersing unit. The gas-liquid ejector unit has an inlet located at the bottom of the cylindrical housing for liquid and the inlet located on side surface of housing for gas, these being between bottom cover of the housing and the first partition. In addition, the inlet for liquid is a nozzle the top having both outside and inside parts of which are adapted to the conical orifice of first partition to provide a required flow-rate of an ejected gas through the gas inlet. The gas-liquid ejector unit communicates through the conical orifice of the first partition with a cavitation unit comprising a hollow cylindrical cavitation chamber having at least one tangential inlet allowing a gas-liquid mixture from a gas-liquid ejector unit to flow inside the hollow cylindrical cavitation chamber for breaking of gas bubbles and further to a jet dispersing unit through an orifice of second partition for additional dispersing and homogenization. The jet dispersing unit comprises a hollow cylindrical dispersing chamber attached to the second partition and communicates with the injection well through an outlet located at the top cover of the cylindrical housing. In addition, the hollow cylindrical dispersing chamber has at least one outlet channel and a hollow dip at the bottom of the hollow cylindrical dispersing chamber.

1 Claim, 1 Drawing Sheet

METHOD AND APPARATUS FOR ENHANCED OIL RECOVERY BY INJECTION OF A MICRO-DISPERSED GAS-LIQUID MIXTURE INTO THE OIL-BEARING FORMATION

TECHNICAL FIELD

The present invention relates to an enhanced oil recovery process with injection of gas-liquid mixture into a reservoir. The process according to the invention finds application notably for improving the displacement of petroleum fluids towards producing wells and therefore for increasing the recovery ratio of the usable fluids, oil and gas, initially in-place in the rock.

BACKGROUND OF INVENTION

The Water-Alternating-Gas (WAG) method where water is combined with gas is a well-known Enhanced Oil Recovery (EOR) method. According to the WAG method, water and gas are injected in succession for as long as petroleum fluids are being produced economically. The purpose of the water slugs is to reduce the mobility of the gas and to widen the swept zone. Many improvements have been proposed for this technique, for example in one method surfactants can be added to the water in order to decrease the water-oil interfacial tension and in another method a foaming agent is added to the water, when foam is created in the presence of gas the mobility of the gas is significantly reduced. The latter method is described in U.S. Pat. No. 3,893,511 or Russian Federation Patent No. 2,039,226. However such a technique requires sophisticated equipment as the parameters of injection must be accurately fulfilled which is difficult to achieve under normal oil field conditions.

U.S. Pat. No. 6,546,962 as well as Russian Federation Patent No. 2,046,931 describe inventions wherein an ejector is used to introduce air or gas into injection water for enhancement of oil recovery. The injection water is supplied to the ejector at a predetermined pressure while at the same time air or associated gas is also being supplied to the ejector. The pressure and velocity of the water passing through the ejector is arranged so as to draw air or gas into the water stream. The amount of gas drawn into the water is preferably capable of being dissolved entirely at the wellhead (or formation) pressure as well as being sufficient to achieve the desired effect in the formation. The ejector uses the energy of the injector pump to accelerate the injection water, thereby reducing the pressure in order to draw in the gas. However, the gas-water mixture stability is low because the size of the gas bubbles cannot be controlled in accordance with these inventions. In addition, a gas/water mixture requires additional compression relative to injection pressure as compared to a water-only system, thus extra energy is needed. The present invention was developed to overcome these and other drawbacks of prior methods and devices by providing an improved method and apparatus for enhanced oil recovery by injection of a gas-liquid mixture into the oil-bearing formation.

SUMMARY OF INVENTION

Accordingly, a primary object of a first embodiment of the present invention is to provide an apparatus for making a micro-dispersed gas-liquid mixture which includes a gas-liquid ejector unit, a cavitation unit and a jet dispersing unit installed in a sequence. All above referenced units are installed into a cylindrical housing which in turn includes bottom and top covers and also has a first partition having a conical orifice separating a gas-liquid ejector unit from a cavitation unit and a second partition separating a cavitation unit from a jet dispersing unit. The gas-liquid ejector unit has an inlet located at the bottom of the cylindrical housing for liquid and inlet located on the side surface of housing for gas, these being between bottom cover of housing and first partition. In addition, the inlet for liquid is a nozzle the top having both outside and inside parts of which are adapted to the conical orifice of first partition to provide a required flowrate of an ejected gas through the gas inlet. The gas-liquid ejector unit communicates through the conical orifice of the first partition with a cavitation unit comprising a hollow cylindrical cavitation chamber having at least one tangential inlet allowing a gas-liquid mixture from a gas-liquid ejector unit to flow inside the hollow cylindrical cavitation chamber for breaking of gas bubbles and further to a jet dispersing unit through an orifice of second partition for additional dispersing and homogenization. The jet dispersing unit comprises a hollow cylindrical dispersing chamber attached to the second partition and communicates with the injection flowline of the injection well through an outlet located at the top cover of the cylindrical housing. In addition, the hollow cylindrical dispersing chamber has at least one outlet channel and a hollow dip at the bottom of the hollow cylindrical dispersing chamber.

It is another object of the invention to provide an apparatus for making a micro-dispersed gas-liquid mixture in which there is no first partition and the gas is ejected into the hollow cylindrical cavitation chamber provided a gas pressure in the gas injection line exceeds the liquid injection line pressure by 0.1–20 percent.

It is further object of present invention to provide a method for enhanced recovery of a petroleum fluid produced by a reservoir, comprising injection of a sweep fluid into an oil-bearing reservoir through an injection well, the sweep fluid comprising a micro-dispersed gas-liquid mixture having size of gas bubbles not exceeding 30 percent of an average diameter of the pores of said oil-bearing reservoir under the pressure in gas injection line in the range of ±20 percent of the pressure in liquid injection line and gas content accounting for 10–40 percent of a micro-dispersed gas-liquid mixture bulk volume.

It is another object of present invention to provide a method for enhanced recovery of a petroleum fluid produced by a reservoir in which the injection of a micro-dispersed gas-liquid mixture and liquid without gas carries out intermittently.

BRIEF DESCRIPTION OF THE DRAWINGS

Other objects and advantages of the invention will become apparent from the study of the following specification when viewed in light of the accompanying drawings, in which.

DETAILED DESCRIPTION OF EMBODIMENT

Figure 1:
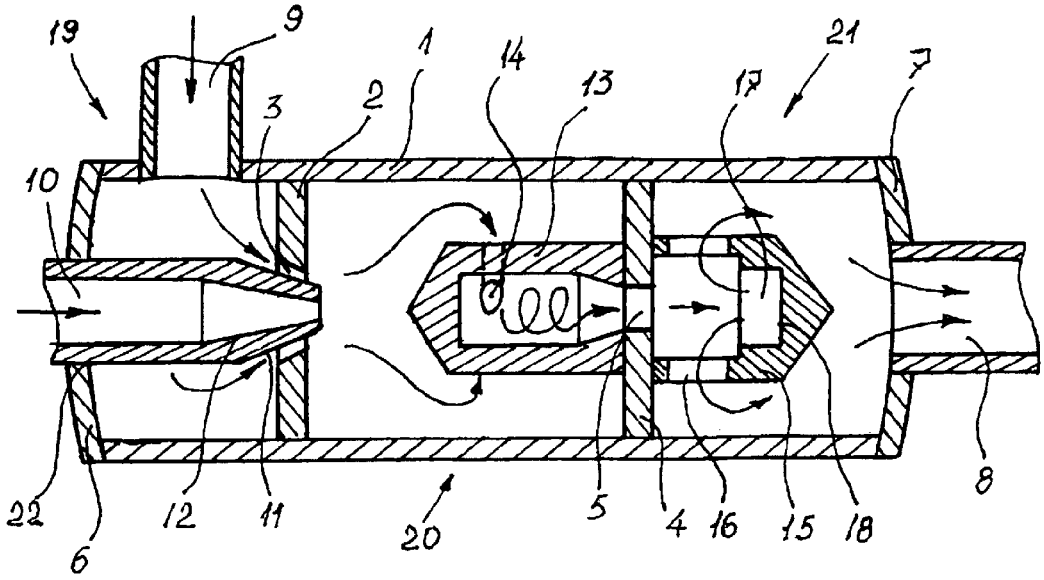
FIG. 1 is a cross-sectional side view of the device according to the invention when the gas is supplied into the gas-liquid ejector unit.

Referring to FIG. 1, there is shown a device for producing a micro-dispersed gas-liquid mixture. The device includes a gas-liquid ejector unit 19, a cavitation unit 20 and a jet dispersing unit 21 installed in a sequence in a cylindrical housing 1 which in turn includes bottom 6 and top 7 covers and also has a first partition 2 having a conical orifice 3 separating a gas-liquid ejector unit 19 from a cavitation unit 20 and a second partition 4 having an orifice 5 separating a cavitation unit 20 from a jet dispersing unit 21. The gas-liquid ejector unit 19 has an inlet nozzle 10 located at the cylindrical housing bottom cover 6 for liquid and the inlet 9 located on side surface of housing 1 for gas. The inlet nozzle 10 for liquid is a nozzle the top both outside 11 and inside 12 parts of which are adapted to the conical orifice 3 of the first partition 2 to provide a required flowrate of an ejected gas through the gas inlet 9. The gas-liquid ejector unit 19 communicates through conical orifice 3 of the first partition 2 with a cavitation unit 20 comprising a hollow cylindrical cavitation chamber 13 having at least one tangential inlet 14 allowing a gas-liquid mixture from a gas-liquid ejector unit 19 to flow inside the hollow cylindrical cavitation chamber 13 and further to jet dispersing unit 21 through an orifice 5 of second 15 attached to the second partition 4 and communicating with the injection flow-line of the injection well through an outlet 8 located at the top cover 7 of the cylindrical housing 1. The hollow cylindrical dispersing chamber 15 has at least one outlet channel 16 and a hollow dip 17 with the reflection surface 18 at the bottom of the hollow cylindrical dispersing chamber 15.

Figure 2:
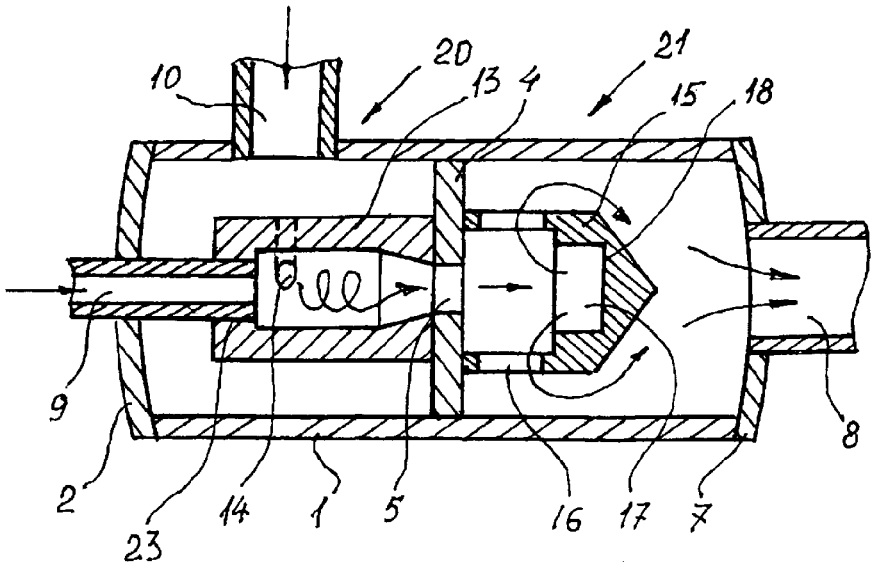
FIG. 2 is a cross-sectional side view of the device according to the invention when the gas is supplied into the cavitation unit.

Referring to FIG. 2, there is shown a device for producing a micro-dispersed gas-liquid mixture if a gas pressure in the gas injection line exceeds the liquid injection pressure by 0.1–20 percent. The device includes a cavitation unit 20 and a jet dispersing unit 21 installed in a sequence in a cylindrical housing 1 which in turn includes bottom 2 and top 7 covers and also has a partition 4 having an orifice 5 separating a cavitation unit 20 from a jet dispersing unit 21. The cavitation unit 20 has an inlet 10 located on side surface of the cylindrical housing 1 for liquid and the inlet 9 located at the bottom for gas which in turn communicates with a hollow cylindrical cavitation chamber 13 having at least one tangential inlet 14 through the orifice 23 of the hollow cylindrical cavitation chamber 13. The cavitation unit 20 communicates with a jet dispersing unit 21 via orifice 5. The jet dispersing unit 21 comprises a hollow cylindrical dispersing chamber 15 attached to the second partition and communicating with the injection flow-line of the injection well through an outlet 8 located at the top cover 7 of the cylindrical housing 1.

The hollow cylindrical dispersing chamber 15 has at least one outlet channel 16 and a hollow dip 17 with the reflection surface 18 at the bottom of the hollow cylindrical dispersing chamber 15.

Operation:

In the case where pressure in the gas injection line is less than the pressure in the liquid injection line by 0–20 percent a device for producing a micro-dispersed gas-liquid mixture operates as following (FIG. 1). The gas is supplied via inlet 9 and liquid is supplied through the inlet nozzle 10 into the gas-liquid ejector unit 19. The velocity of the liquid in the right end of the inlet nozzle 10 increases due to its conical surface 12. The outside surface 11 of the inlet nozzle 10 is adapted to the conical surface 11 of first partition 2 in such manner that flow of liquid through the inlet nozzle 10 causes the drawing of a gas from inlet 9 into an annular orifice created by conical surfaces 11 and 3 correspondingly. The first mixing of gas and liquid has then occurred. The gas-liquid mixture then goes to the hollow cylindrical cavitation chamber 13 of the cavitation unit 20 via at least one tangential inlet 14 wherein it is rotated. A cavity then appears due to the decrease of hydrodynamic pressure along the axis of symmetry of the hollow cylindrical cavitation chamber 13. The cavity that is formed is unstable and collapses quickly generating micro-shockwaves that break up the gas bubbles and further homogenize the gas-liquid mixture. Further, the gas-liquid mixture is supplied into the hollow cylindrical dispersing chamber 15 of the jet dispersing unit 21 via orifice 5 wherein it interacts with the reflection surface 18 of a hollow dip 17 causing the appearance of the pulsating cavity which in turn provides additional decrease of the gas bubble sizes and homogenization of the gas-liquid mixture. After which the gas-liquid mixture goes to the outlet 8 via at least one outlet channel 16 and further to the injection line of the injection well to be injected into the oil-bearing formation.

In the case where pressure in the gas injection line exceeds that in the liquid injection line by 0.1–20 percent a device for producing a micro-dispersed gas-liquid mixture operates as follows (FIG. 2). The gas is supplied directly into the hollow cylindrical cavitation chamber 13 of the cavitation unit 20 via orifice 23 of inlet 9 and the liquid is supplied into the hollow cylindrical cavitation chamber 13 via the at least one tangential inlet 14 wherein the cavitation phenomenon described above is occurred. Further the gas-liquid mixture is supplied into the hollow cylindrical dispersing chamber 15 of the jet dispersing unit 21 via orifice 5 wherein it interacts with the reflection surface 18 of a hollow dip 17 causing the appearance of the pulsating cavity which in turn, as described previously, provides an additional decrease in gas bubble sizes and homogenization of the gas-liquid mixture. After which the gas-liquid mixture enter into the outlet 8 via at least one outlet channel 16 and further to the injection line of the injection well to be inject into the oil-bearing formation.

In addition, the present invention is a highly efficient process for enhanced recovery of petroleum fluids produced by a reservoir. The process entails injection of a sweep fluid into an oil-bearing reservoir through an injection well wherein the sweep fluid is a micro-dispersed gas-liquid mixture having gas bubble sizes not exceeding 30 percent of the average diameter of the oil-bearing reservoir pores, performed when the pressure in gas injection line is less than 20 percent of the pressure in liquid injection line and the gas content accounts for 10–40 percent of the micro-dispersed gas-liquid mixture's bulk volume. Under these conditions the micro-dispersed gas-liquid mixture effectively sweeps the residual oil from the oil-saturated porous medium. For example the oil-bearing productive layer $AB_{4.5}$ of the Samotlor oil field (West Siberia, Russia) underwent an injection of the micro-dispersed gas-liquid mixture during a period of 12 months. There were 90 production wells and 28 injection wells wherein the injection of the micro-dispersed gas-liquid mixture was performed. The average production rate prior to stimulation was 9.6 tons/day per well of an oil and 304 tons/day per well of fluid and the average injection rate was 500 tons/day per well. The water cut accounted for 96%. The average permeability of productive layer accounted for $4*10^{-1}$ $mc^2$ which corresponds to 150 microns of average size of pores of the fluid saturated porous medium. The average diameter of the gas bubbles in the injected micro-dispersed gas-liquid mixture accounted for 30–50 microns. The gas content in the micro-dispersed gas-liquid mixture had been changing in the range 10–40% depending on the injection pressure in the gas injection line which in turn was accounted for 8–13.2 MPa. The injection pressure in the liquid injection line accounted for 10–11 MPa. Over the previous 12 months 18.4 million standard cubic meters of gas was injected. The additional oil production due to the injection of the micro-dispersed gas-liquid mixture accounted for 21000 tons.

In addition, the present invention is highly efficient in providing a process for enhanced recovery of a petroleum fluid produced by a reservoir wherein occurs the intermittent injection of a micro-dispersed gas-liquid mixture after exiting from outlet 8 and liquid without gas, in cases where the permeability of the oil-bearing productive layer is less than 5–10 mD.

While in accordance with the provisions of the Patent Statutes the preferred forms and the embodiments of the invention have been illustrated and described, it will be apparent to those of ordinary skill in the art various changes and modifications may be made without deviating from the inventive concepts set forth above.

Having described the invention we, claim:

1. Apparatus for producing a micro-dispersed gas-liquid mixture, comprising a cylindrical housing having a cylindrical surface with bottom and top covers, which in turn incorporate:

a gas-liquid ejector unit consisting of said bottom cover of said cylindrical housing, a first part of said cylindrical surface of said housing, an inlet for gas connected to a gas injection line, an inlet nozzle for liquid connected to an injection liquid line and a first partition of said cylindrical housing, said inlet nozzle having has both outside and inner surfaces to adapt a conical orifice of said first partition to provide a required flow-rate of an ejected gas through said gas inlet;

a cavitation unit communicating through said first partition with said gas-liquid ejector unit, said cavitation unit comprising said first partition, a second part of said cylindrical surface of said housing, a hollow cylindrical cavitation chamber having at least one tangential inlet allowing a gas-liquid mixture from said gas-liquid ejector unit to flow inside the hollow cylindrical cavitation chamber and a second partition having an orifice connected to said hollow cylindrical cavitation chamber;

a jet dispersing unit communicating though said second partition orifice with said cavitation unit comprising said second partition, a third part of said cylindrical surface of said cylindrical housing, a hollow cylindrical dispersing chamber attached to said second partition, said top cover of said cylindrical housing and an outlet connected to an injection well, said hollow cylindrical dispersing chamber includes at least one outlet channel and a hollow dip at the bottom of said hollow cylindrical dispersing chamber, said outlet channel communicates with said outlet connected to said injection well.

* * * * *